US005603493A

United States Patent [19]

Kelly

[11] Patent Number: 5,603,493

[45] Date of Patent: Feb. 18, 1997

[54] SYSTEM FOR USE IN HANDLING MEDIA

[75] Inventor: Kieran B. Kelly, Vancouver, Wash.

[73] Assignee: Hewlett Packard Company, Palo Alto, Calif.

[21] Appl. No.: 348,624

[22] Filed: Dec. 3, 1994

[51] Int. Cl.[6] ..... B65H 29/70

[52] U.S. Cl. ..... 271/188; 271/192; 271/312

[58] Field of Search ..... 271/188, 189, 271/192, 209, 213, 307, 312, 313

[56] References Cited

U.S. PATENT DOCUMENTS

| | | | |
|---|---|---|---|
| 1,891,286 | 12/1932 | Miersch | 271/188 |
| 3,135,509 | 6/1964 | Zweig | 271/188 |
| 3,240,490 | 3/1966 | Fairbanks et al. | 271/188 |
| 3,897,052 | 7/1975 | Turman et al. | 271/188 |
| 3,934,872 | 1/1976 | Honkawa | 271/188 |
| 4,728,963 | 3/1988 | Rasmussen et al. . | |
| 4,774,523 | 9/1988 | Beaufort et al. . | |
| 4,794,859 | 1/1989 | Huseby et al. . | |
| 5,016,867 | 5/1991 | Kamath | 271/188 |
| 5,031,894 | 7/1991 | Bedzyk et al. | 271/240 |
| 5,091,754 | 2/1992 | Abe et al. | 271/188 |
| 5,188,351 | 2/1993 | Gysling . | |
| 5,226,743 | 7/1993 | Jackson et al. . | |
| 5,269,613 | 12/1993 | Olson et al. . | |
| 5,286,018 | 2/1994 | Rasmussen et al. . | |
| 5,299,875 | 4/1994 | Hock et al. . | |
| 5,324,020 | 6/1994 | Rasmussen et al. . | |
| 5,366,216 | 11/1994 | Ahlvin | 271/171 |
| 5,377,966 | 1/1995 | Ohmori | 271/3 |
| 5,419,548 | 5/1995 | Ueda et al. | 271/294 |
| 5,434,660 | 7/1995 | Yoshida et al. | 355/309 |

FOREIGN PATENT DOCUMENTS

| | | | |
|---|---|---|---|
| 1419508 | 12/1975 | United Kingdom . | |
| 2037712 | 7/1980 | United Kingdom | 271/189 |

*Primary Examiner*—H. Grant Skaggs

[57] ABSTRACT

A sheet media handling system is provided for use in supporting a sheet which has been expelled from an ink-jet printer's output port while ink on a preceding sheet is allowed time to dry. The system employs a guide mechanism with an elongate channel which receives a predetermined side edge of an expelled sheet. The channel is provided with an elongate first channel segment which extends in substantially parallel fashion with a generally horizontal media outflow axis, and an elongate second channel segment which turns upwardly and inwardly from the first channel segment, thereby establishing a sheet-stiffening bow in the expelled sheet.

16 Claims, 3 Drawing Sheets

SYSTEM FOR USE IN HANDLING MEDIA

TECHNICAL FIELD

The present invention relates generally to the handling of media, and more particularly, to a system for use in supporting sheet media which are expelled through a printer's output port. Although the invention has broad utility, it has proven particularly well suited for use in an ink-jet printer wherein a printed sheet is to be momentarily supported above an output tray while ink on a preceding sheet is allowed time to dry.

BACKGROUND ART

In a conventional ink-jet printer, sheet media are directed through a print cycle which includes picking up a sheet from an input tray, feeding it through the printer's printing zone, and then expelling it through an output port. Once expelled, the sheet falls to an output tray, consecutive sheets piling one on top of the other to form an output stack. Because ink-jet printers print using wet ink, and because sheets often are stacked immediately after printing, ink-jet printers have in the past experienced difficulty with blotting and/or smearing of ink upon contact between consecutively printed sheets. This has been particularly apparent where the ink drying time exceeds the time between printing of consecutive sheets. Although a variety of solutions have been proposed to deal with this problem, none have provided adequate ink drying time without some cost to the printer's efficiency, versatility or size.

Some manufacturers have, for example, attempted to eliminate ink smearing and blotting problems by decreasing the ink's drying time. One solution has been to employ quick-drying ink, or specially coated paper. These products, however, have not always been available, and have often produced poor quality print. Another solution has been to provide some sort of drying lamp or heater adjacent the printed media, but this adds to the complexity of the printer, and consequently adds to the printer's price.

Other manufacturers have attempted to delay the deposit of printed sheets in the output tray so as to provide the previously-printed sheet with adequate drying time. The most basic of such solutions have involved simply slowing printer throughput by creating an artificial time delay between the printing of consecutive sheets. Although this solution does increase the time available for ink to dry, it has proven unacceptable in view of the ever-increasing desire to improve printer efficiency and speed.

Another solution proposed by printer manufacturers has been to employ a passive drop scheme wherein a sheet emerging from the printer's output port is guided along rails which suspend the sheet above the output tray. At the completion of printing, the sheet simply drops of its own weight into the output tray, the previously-printed sheet having had an opportunity to dry during printing of the present sheet. However, passive drop schemes are not always reliable due to a phenomenon known as cockling. As a result of such cockling, sheets do not always drop into the output tray after printing, but instead are pushed forward and out of the printer by the following sheet. This cockling effect becomes more pronounced with environmental extremes and large amounts of ink on the sheet.

Yet another common solution has involved the use of an active drop mechanism wherein a printed sheet is guided along a pair of movable wings which temporarily support the sheet above the printer's output tray. Once printing is completed, the wings retract, often pivotally, allowing the sheet to fall to an output tray below. The previously-printed sheet thus is provided with time to dry during printing of the present sheet. Although generally effective, active wing arrangements generally are not suitable for a wide range of media widths, and can significantly increase the printer's chassis size. Active drop mechanisms also may present problems related to sheet sail, a phenomenon which can result in sheets gliding out of the printer upon retraction of the wings.

DISCLOSURE OF THE INVENTION

In accordance with the present invention, a sheet media handling system is provided for use in supporting a sheet in a sheet-stiffening bow. In its preferred embodiment, the system is configured to support a sheet expelled from an ink-jet printer's output port while ink on a preceding sheet is allowed time to dry. The system thus employs a guide mechanism with an elongate channel which receives a predetermined side edge of an expelled sheet. The channel is provided with an elongate first channel segment which extends in substantially parallel fashion to a generally horizontal media outflow axis, and an elongate second channel segment which turns inwardly and upwardly from the first channel segment, thereby establishing a sheet-stiffening bow in the expelled sheet. The guide mechanism preferably is retractable, and includes a media stripper, to provide for selected release of sheets.

DETAILED DESCRIPTION OF THE PREFERRED EMBODIMENT AND BEST MODE FOR CARRYING OUT THE INVENTION

Figure 1:
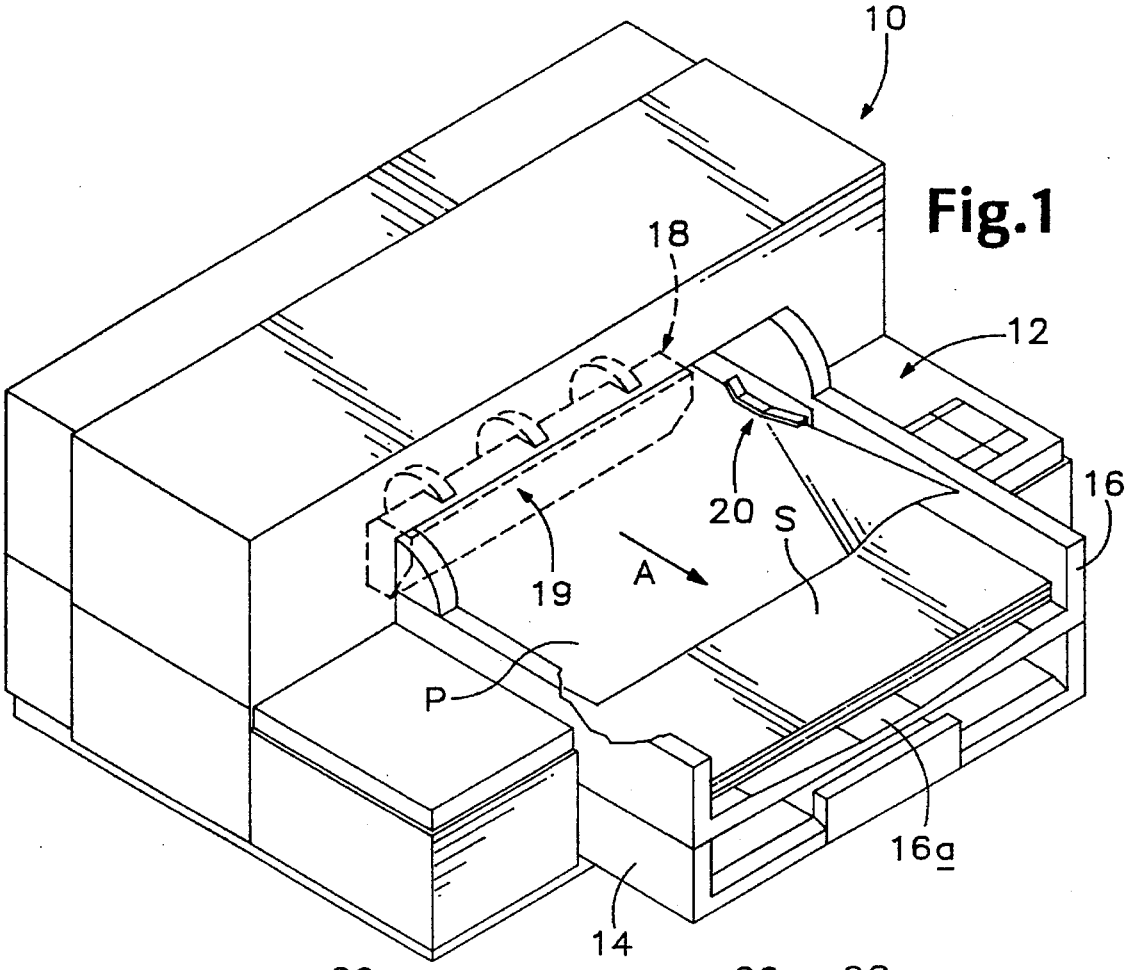
FIG. 1 is an isometric view of a single-sheet ink-jet printer, such printer incorporating a media handling system constructed in accordance with a preferred embodiment of the present invention.

With reference now to FIG. 1, there is shown a typical single-sheet ink-jet printer 10, such printer including a chassis 12 which is configured to receive an input tray 14 and an output tray 16. The input tray holds media prior to input. The output tray holds media once it has been printed on and expelled. A media advancement mechanism 18 directs the media through the printer, sheets being pulled consecutively from the input tray and passed downstream through the printer's printing zone where ink is deposited on the sheets. The sheets are then expelled through an output port 19 along a generally horizontal outflow axis A for subsequent stacking in the output tray. As is conventional, the output tray is positioned adjacent the printer's chassis, the tray's floor 16*a* generally lying some distance below the output port.

In accordance with the present invention, printer 10 is provided with a media handling system which temporarily supports a printed sheet P above the output stack while ink on a preceding printed sheet S is afforded time to dry. Once the ink on sheet S has dried, sheet P is released and falls to the output tray. Optimally, the release of sheet P will correspond closely with the completion of printing on sheet P so as to avoid delay in printer throughput. The invented system thus will avoid smearing or blotting of ink which might otherwise result from premature contact between consecutively expelled sheets.

As indicated in FIG. 1, the media handling system supports printed sheet P above the output stack in cantilever fashion by guiding such sheet into a sheet-stiffening bow. Toward this end, the system includes a single guide mechanism 20 which is mounted adjacent a side edge of the output port so as to define a track for traverse by a corresponding side edge of sheet P upon expulsion of the sheet from the printer's output port. In the preferred embodiment the guide mechanism is mounted adjacent the right side edge of the output port (as viewed in FIG. 1), thus accommodating right-justified transfer of sheets. Those skilled will appreciate, however, that left-justified transfer could similarly be accommodated by mounting the guide mechanism adjacent the left side edge of the output port.

Figure 2:
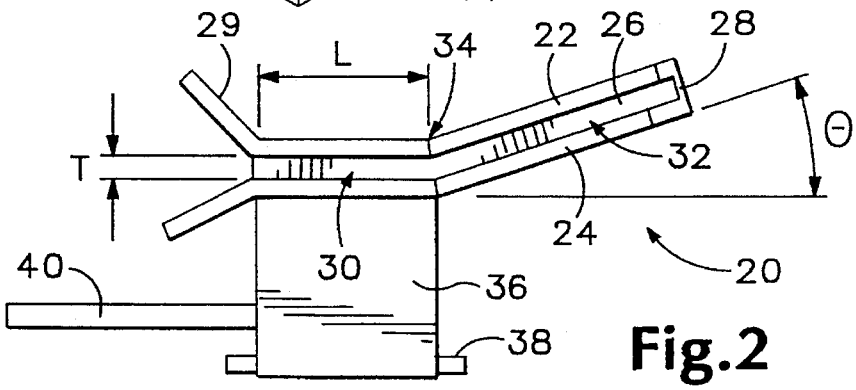
FIG. 2 is an enlarged side elevational view of a guide mechanism which forms a part of the media handling system depicted in FIG. 1.
Figure 3:
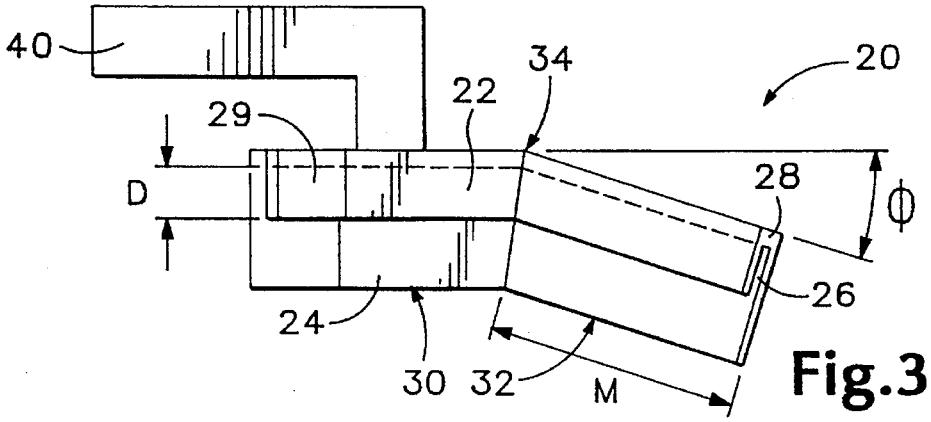
FIG. 3 is a top plan view of the guide mechanism which is depicted in FIG. 2.

Referring now to FIGS. 2 and 3, which illustrate guide mechanism 20 in detail, it will be noted that such guide mechanism is formed with a pair of narrowly spaced guide surfaces 22. 24 which serve to define an elongate channel 26 (or slot) therebetween. The channel, in turn, defines a track for sheets expelled from the printer's output port. Sheets are not pinched between the guide surfaces, but rather are captured within the channel by frictional forces sufficient to support the sheet. The guide mechanism thus is formed with a channel thickness which is only slightly thicker than conventional sheet media such as paper, envelopes, or card stock. In the preferred embodiment, channel 26 has a thickness T which is on the order of approximately 0.8 to 1.2 millimeters.

The channel's depth is defined by an upright side wall 28 which extends between the guide surfaces as shown. The channel is thus generally U-shaped, defining a track for traverse by a predetermined side edge of an advancing sheet as described above. The channel's depth D is chosen to accommodate passage of printed sheets without smearing the print thereon, such depth generally corresponding to the minimum allowable margin of acceptable media sheets. In the preferred embodiment, the channel depth is chosen to be approximately 3.4 millimeters, a depth which corresponds to the minimum margin of most conventional sheets. It will be noted, however, that lower guide surface 24 is wider than either depth D or upper guide surface 22, thus providing improved sheet support. This is possible because printing generally occurs on a sheet's upper surface, and thus ink will not be smeared by a lower guide surface which extends beyond the sheet's print margin.

An advancing sheet will pass from the printer's output port and into channel 26 through an inlet 29 which is defined by a divergence of the guide surfaces, typically angle of approximately 45-degrees. Such divergence provides for reliable receipt of sheet media. Those skilled will appreciate, however, that such angle is not critical to the invention, and may vary according to tolerances of the printer in which the system is employed.

Pursuant to an important feature of the invention, channel 26 will be seen to bend so that a sheet advancing through the channel will be provided with a sheet-stiffening bow, or curl. Guide mechanism 20 thus may be considered to define a channel with first and second angularly offset channel segments 30, 32. The first channel segment extends substantially parallel to the outflow axis within a generally horizontal first plane. The second channel segment extends angularly from the first channel segment in a second plane, defining a bend in the channel at 34. In the preferred embodiment, the channel turns both inwardly (across the media flow path) and upwardly (from a horizontal printing plane) so as to define a bow in the supported sheet which extends diagonally thereacross (see FIG. 1). This diagonal bow is achieved via a channel which turns upwardly at an angle $\theta$ (see FIG. 2) which is between approximately 5-degrees and 25-degrees, and turns inwardly at an angle $\Phi$ (see FIG. 3) which is between approximately 5-degrees and 15-degrees. The upward bend is established by bending guide surfaces 22, 24. The inward bend is established by bending wall 28 so as to define first and second side wall sections which are angularly offset. The resulting bend in the channel has been found to provide a sufficient stiffening characteristic to a sheet of conventional length and width.

Guide mechanism 20 preferably is configured to begin bowing an advancing sheet at a distance from the printer's output port so as to stiffen the advancing sheet without deflecting the sheet-stiffening bow back into the printer's printing zone. Such deflection, it will be understood, would reduce the consistency of head-to-media distance, and thus detrimentally effect print quality. The first channel segment thus has a length L of between approximately 10 millimeters and 15 millimeters. This length is believed to ensure against deflection of the sheet-stiffening bow back into the printing zone. The second channel segment, has a length M of between approximately 15 millimeters and 25 millimeters. This length has been chosen to provide adequate support for an expelled sheet.

Figure 4:
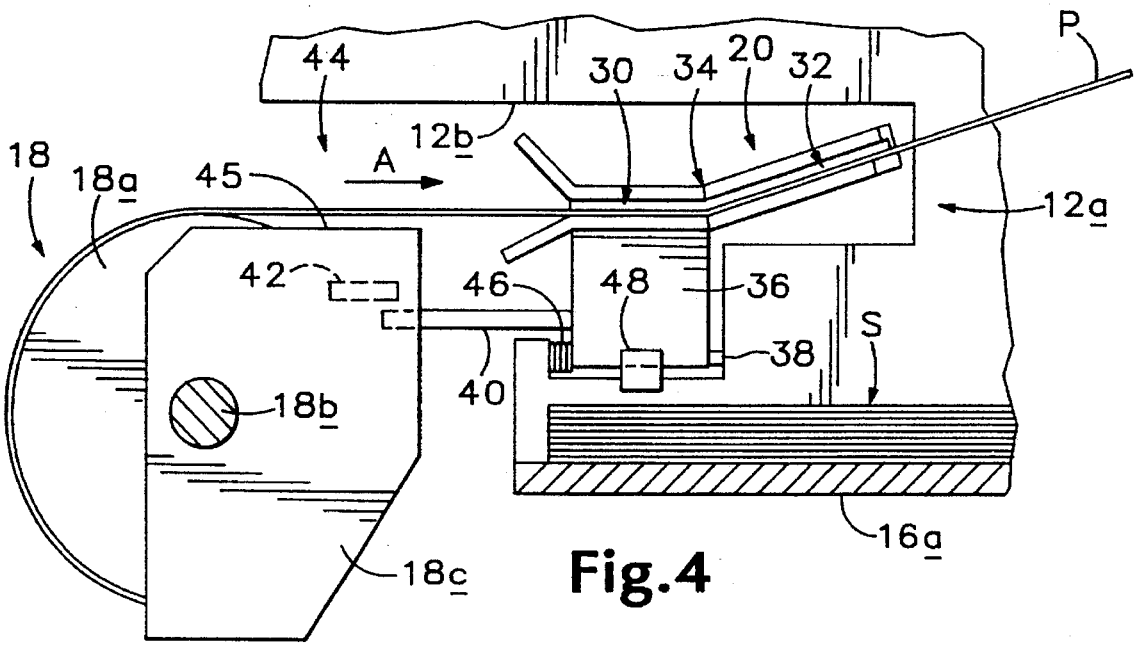
FIG. 4 is an enlarged, fragmentary, side sectional view of the printer depicted in FIG. 1, such view illustrating support of an expelled sheet by the preferred embodiment system.
Figure 5:
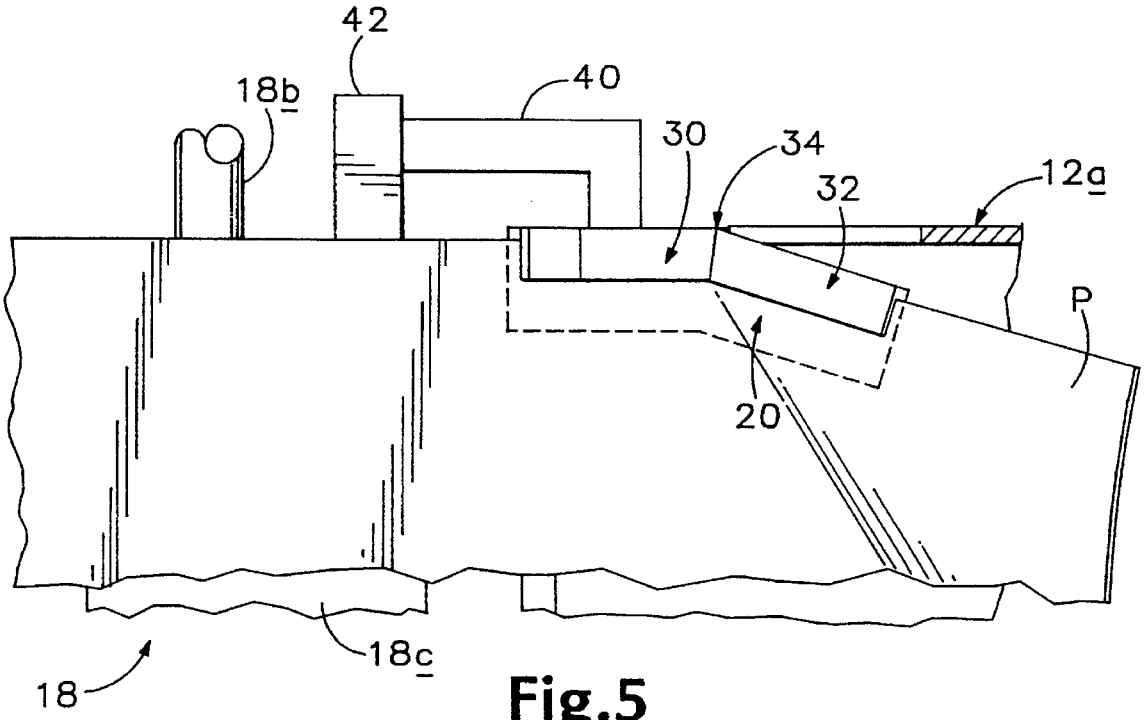
FIG. 5 is an enlarged, fragmentary, top sectional view of the printer fragment depicted in FIG. 4.

FIGS. 4 and 5 depict the media handling system during expulsion of sheet P from the printer, the system's guide mechanism 20 being mounted in a configuration whereby sheet P is supported in cantilever fashion above the output stack. Guide mechanism 20 thus will be seen to include a channel support 36 which extends downwardly (as viewed in FIG. 4) from first channel segment 30 to pivotally mount the guide mechanism to the printer's chassis. This is accomplished via an elongate rod 38 which extends oppositely from channel support 36 to seat in corresponding chassis apertures (not shown). The guide mechanism thus is made retractable to provide for the release of a printed sheet once the ink on the preceding sheet has dried.

Guide mechanism 20 is biased to a nominal orientation via a spring such as torsion spring 46, such spring preferably being mounted on shaft 38 to urge the guide mechanism into an orientation suited for capture of the media's side edge. A stop 48 is provided on the chassis to prevent the guide mechanism from pivoting past the nominal orientation. Stop 48, it will be noted, is positioned to engage channel support 36 when the guide mechanism is pivoted to its nominal orientation.

The advancing sheet P is directed through the printer via a media advancement mechanism 18 which includes a roller 18*a* driven by a shaft 18*b*. The roller operates to pass media from the printer's input port to the printer's printing zone 44, and subsequently along an outflow axis A to guide mechanism 20 as has been explained. A pivoting platen structure 18*c* further aids in directing advancement of sheet P, the platen structure being pivoted to direct pick-up and expulsion of sheets. The platen structure also defines a platen 45 which supports media in a generally horizontal printing plane.

Upon expulsion of the sheet's trailing edge, the guide mechanism is retracted, thus releasing the expelled sheet for passage to the output tray. Preferably, guide mechanism 20 is automatically retractable, such guide mechanism incorporating an elongate release tab 40 which is engaged upon pivot of platen structure 18*c*. In the depicted embodiment, platen structure 18*c* includes a projecting ear 42 which is positioned to cammingly engage release tab 40 when a printed sheet has been completely expelled. This camming engagement urges guide mechanism 20 from its nominal orientation (FIGS. 4 and 5), and into a retracted orientation (FIGS. 6 and 7).

Figure 6:
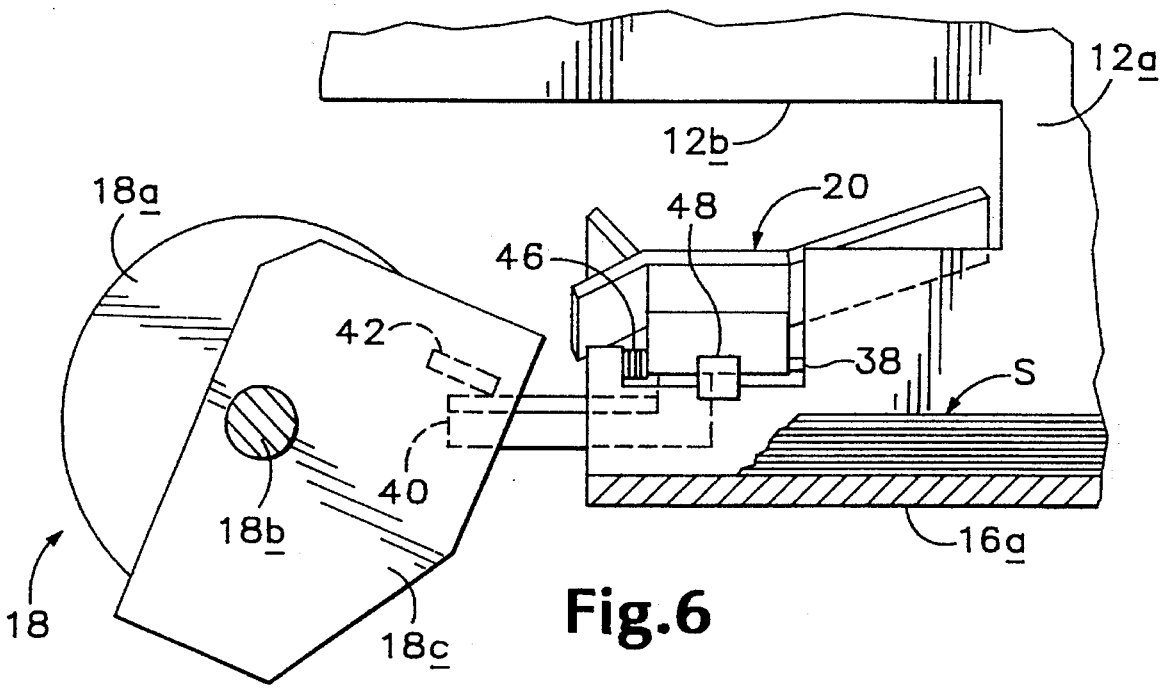
FIG. 6 is a view similar to that of FIG. 4, but with the guide mechanism retracted so as to release the expelled sheet.
Figure 7:
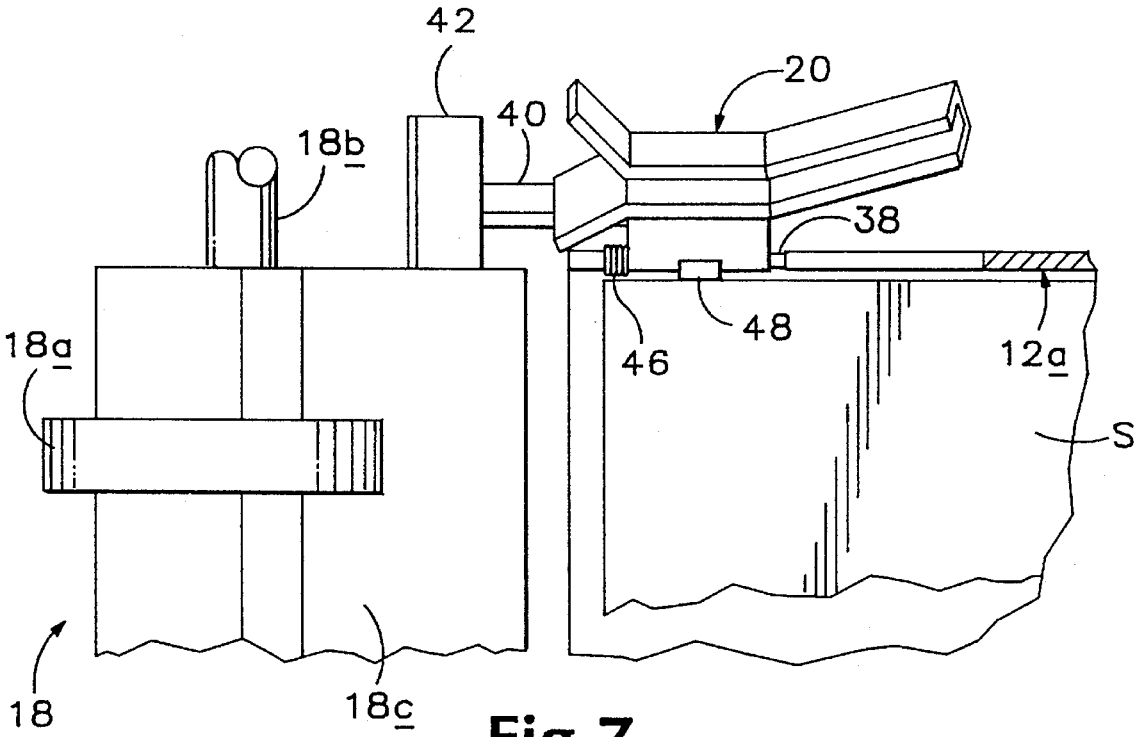
FIG. 7 is a view similar to that of FIG. 5, but with the guide mechanism retracted so as to release the expelled sheet.

As best indicated in FIGS. 6 and 7, guide mechanism 20 pivotally retracts through an aperture 12*b* in the printer's chassis. A paper stripper in the form of wall section 12*a* engages sheet media within the guide mechanism's channel but does not obstruct pivot of the guide mechanism. A sheet is thus urged from the channel upon pivot of the guide mechanism, allowing the sheet to fall to stack S. By virtue of the bow created by the guide mechanism, sheets are released in a manner which encourages vertical stacking of the sheets in the output tray.

Industrial Applicability

Although particularly well-suited for use in single-sheet, ink-jet printers, the above-described media handling system is useful in virtually any machine wherein a sheet is to be supported with a minimal of intrusion. The system is effective in guiding a sheet of media such as paper into an orientation wherein the sheet is stiffened diagonally across a substantial portion of its length. In this manner, sheets may be supported from a single side edge, and in a relatively small region of that side edge.

While the present invention has been shown and described with reference to the foregoing operational principles and preferred embodiment, it will be apparent to those skilled in the art that various changes in form and detail may be made without departing from the spirit and scope of the invention as defined by the claims.

I claim:

1. A media handling system for use in supporting media during advancement along a predetermined flow axis, said system comprising:

a pair of narrowly spaced guide surfaces which extend along the flow axis to define an elongate slot whereby advancing media is directed downstream, said slot including a first segment which extends in a first plane, and a second segment which extends angularly from said first segment in a second plane so as to establish a sheet-stiffening bow in the advancing media; and an elongate side wall which extends across said slot to direct a predetermined side edge of the advancing media downstream, said side wall having a first section which extends substantially parallel to a nominal media side edge flow path, and a second section which turns inwardly from said nominal media side edge flow path toward the media's opposite side edge.

2. The system of claim 1, wherein said second segment extends downstream from said first segment at an angle which is within a range of between approximately 5-degrees and 25-degrees from the first plane.

3. The system of claim 1, wherein said second section bends inwardly from said first section at an angle which is within a range of between approximately 5-degrees and 15-degrees.

4. A media handling system for use in supporting media expelled through file output port of a printer along a generally horizontally outflow axis, said system comprising:

a retractable guide mechanism which defines an elongate channel configured nominally to extend downstream from a predetermined side edge of the output port for receiving a corresponding predetermined side edge of the expelled media, said channel including an elongate first channel segment which extends substantially parallel to the outflow axis, and an elongate second channel segment which turns upwardly from said first channel segment to establish a stiffening curl in tile expelled media, said guide mechanism including a release tab configured for engagement by a pivoting platen structure of the printer upon completion of printing on a media sheet.

5. The system of claim 4, wherein said second channel segment bends upwardly from said first channel segment at an angle which is between approximately 5-degrees and 25-degrees.

6. The system of claims 4, wherein said second channel segment turns inwardly from said first channel segment.

7. The system of claim 4, wherein said second channel segment bends inwardly from said first channel segment at an angle which is between approximately 5-degrees and 15-degrees.

8. The system of claim 4, wherein said guide mechanism retracts automatically upon expulsion of a trailing edge of the media from the output port.

9. The system of claim 4, wherein said guide mechanism is pivotally retractable.

10. The system of claim 4 which further comprises a media stripper which is positioned to urge media from said channel upon retraction of said guide mechanism.

11. The system of claim 4 wherein said pivoting platen structure engages said release tab in camming relation to urge said guide mechanism toward a retracted orientation.

12. A sheet media handling system for use in a printer having a media advancement mechanism which passes sheet media across a platen in a generally horizontal printing plane, and thereafter expels the media through an output port along an outflow axis which lies within the printing plane, said system comprising:

a retractable guide mechanism configured to capture sheets expelled from the output port, said guide mechanism including an elongate U-shaped channel which nominally extends from adjacent a predetermined side edge of the output port to define a track for traverse by a corresponding predetermined side edge of an advancing media sheet, said channel having a first channel segment which extends from the output port in parallel with the outflow axis, and a second channel segment which turns inwardly and upwardly from the first channel segment;

a stationary media stripper positioned to urge media sheets from said channel upon retraction of said guide mechanism, thereby releasing the media sheets from the guide mechanism; and an output tray having a floor which extends from beneath the output port to capture sheets released by the guide mechanism.

13. The system of claim 12, wherein said second channel segment turns inwardly from the first channel segment at an angle which is between approximately 5-degrees and 15-degrees, and turns upwardly from the first channel segment at an angle which is between approximately 5-degrees and 25-degrees.

14. The system of claim 12, wherein said guide mechanism is spring-biased toward a nominal orientation wherein said first channel segment is aligned with a predetermined side edge of the output port.

15. The system of claim 12, wherein said guide mechanism includes a release tab which is fixed relative to the channel, the sheet media advancement mechanism being configured to operatively engage said release tab upon completion of printing on a media sheet so as to urge said guide mechanism into a retracted orientation.

16. The support system of claim 15, wherein said guide mechanism is pivotally retractable.

* * * * *